US008306458B2

(12) United States Patent
Takeuchi

(10) Patent No.: US 8,306,458 B2
(45) Date of Patent: Nov. 6, 2012

(54) IMAGE FORMING DEVICE INCLUDING REGULATION MEMBER THAT REGULATES MOVEMENT OF FLAPPER WHEN REAR COVER IS OPEN

(75) Inventor: Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 427 days.

(21) Appl. No.: 12/706,999

(22) Filed: Feb. 17, 2010

(65) Prior Publication Data

US 2010/0247146 A1 Sep. 30, 2010

(30) Foreign Application Priority Data

Mar. 30, 2009 (JP) ..... 2009-082200

(51) Int. Cl.
*G03G 15/00* (2006.01)
*G03G 21/00* (2006.01)

(52) U.S. Cl. ..... 399/124; 399/21

(58) Field of Classification Search ..... 399/124
See application file for complete search history.

(56) References Cited

U.S. PATENT DOCUMENTS

| | | | | |
|---|---|---|---|---|
| 5,045,887 | A * | 9/1991 | Nakamura | 399/122 |
| 5,300,998 | A | 4/1994 | Ogisawa et al. | |
| 2004/0086285 | A1* | 5/2004 | Yoshikawa | 399/13 |
| 2006/0127127 | A1* | 6/2006 | Eom | 399/110 |
| 2006/0216060 | A1* | 9/2006 | Kuwata et al. | 399/110 |
| 2007/0092294 | A1* | 4/2007 | Jang | 399/124 |
| 2008/0286003 | A1 | 11/2008 | Fukuda et al. | |
| 2008/0310895 | A1 | 12/2008 | Masuda et al. | |
| 2009/0297243 | A1 | 12/2009 | Matsuno | |
| 2010/0034559 | A1* | 2/2010 | Sahara | 399/122 |
| 2010/0278557 | A1* | 11/2010 | Somemiya et al. | 399/124 |

FOREIGN PATENT DOCUMENTS

| | | | |
|---|---|---|---|
| JP | 5027628 | A | 2/1993 |
| JP | 5-30858 | | 4/1993 |
| JP | 7271223 | A | 10/1995 |
| JP | 8160830 | A | 6/1996 |
| JP | 10240099 | A | 9/1998 |
| JP | 2006-079121 | | 3/2006 |

(Continued)

OTHER PUBLICATIONS

Office Action for Japanese application No. 2009-082200 mailed Mar. 15, 2011.

*Primary Examiner* — Walter L Lindsay, Jr.
*Assistant Examiner* — David Bolduc
(74) *Attorney, Agent, or Firm* — Banner & Witcoff, Ltd.

(57) ABSTRACT

An image forming device includes a heat member and a pressure member in pressed contact with the heat member, forming a nip part therebetween. A cover member of a main casing is movable between a first closed position for covering the heat member and a first open position for exposing the heat member. A flapper disposed between the cover member and the nip part is movable between a second closed position for covering the heat member and a second open position for exposing the heat member. The flapper toggles between conveying paths. A regulating member is capable of regulating movement of the flapper to the second open position when the cover member is in the first open position so as to maintain the heat member covered by the flapper.

10 Claims, 10 Drawing Sheets

FOREIGN PATENT DOCUMENTS

| | | | |
|---|---|---|---|
| JP | 2007-140370 | | 6/2007 |
| JP | 2007320689 | A | 12/2007 |
| JP | 2008052142 | A | 3/2008 |
| JP | 2008310303 | A | 12/2008 |
| JP | 2009286583 | A | 12/2009 |
| JP | 2009286584 | A | 12/2009 |

* cited by examiner

FIG.7(a)
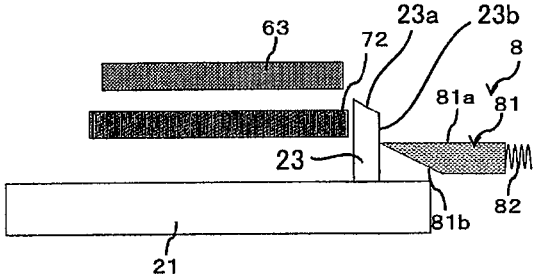
FIG.7(b)
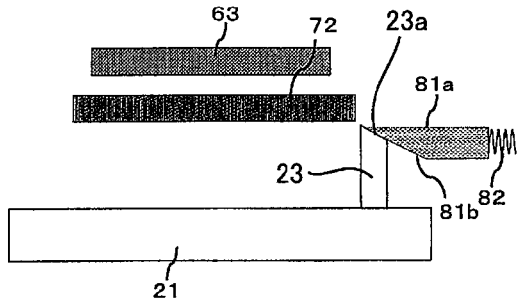
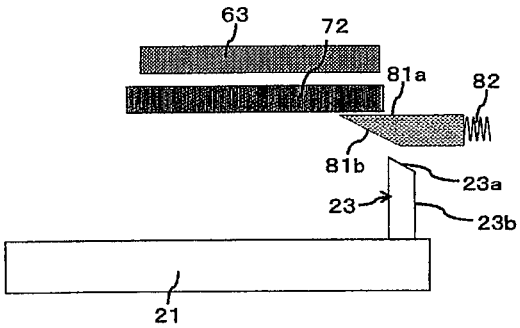
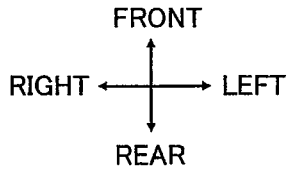
FIG.7(c)

FIG.11(a)
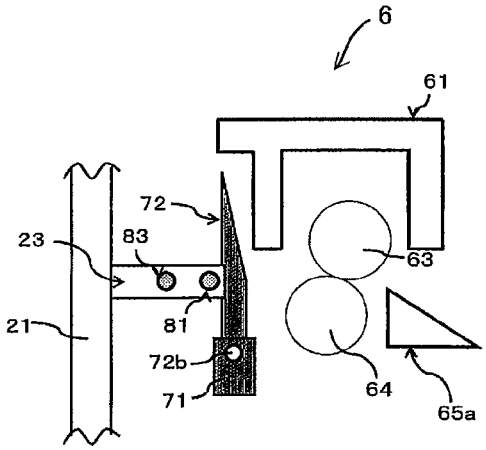
FIG.11(b)
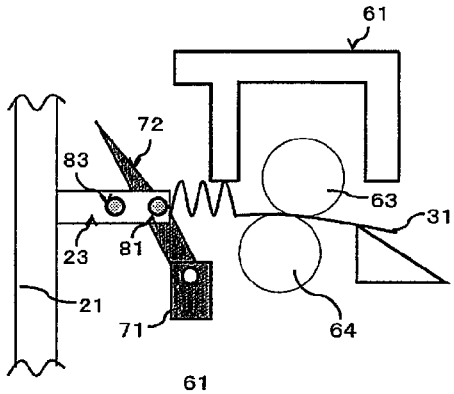
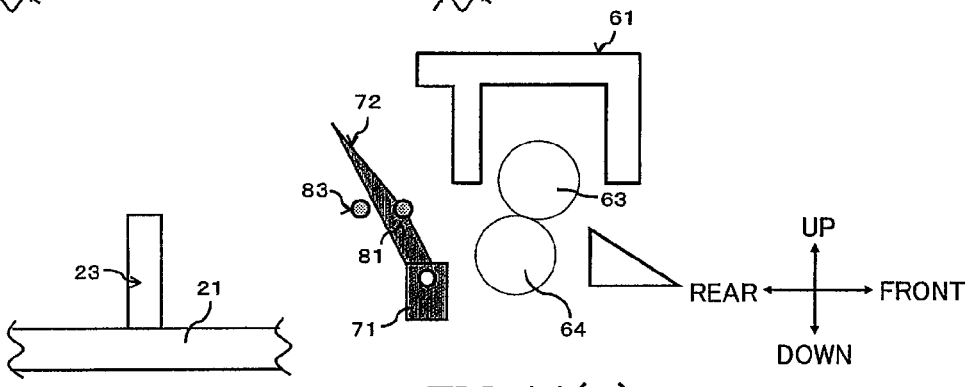
FIG.11(c)

IMAGE FORMING DEVICE INCLUDING REGULATION MEMBER THAT REGULATES MOVEMENT OF FLAPPER WHEN REAR COVER IS OPEN

CROSS REFERENCE TO RELATED APPLICATION

This application claims priority from Japanese Patent Application No. 2009-082200 filed Mar. 30, 2009. The entire content of this priority application is incorporated herein by reference.

TECHNICAL FIELD

The present invention relates to an image forming device, and more particularly to a laser printer.

BACKGROUND

There has been proposed an electrophotographic image forming device including a main casing having a cover capable of selectively opening and closing, a fixing unit for fixing toner images onto a sheet of recording paper, and a flapper disposed between the cover and the fixing unit. The fixing unit includes a heat roller and a pressure roller. The flapper is pivotable to toggle between paper conveying paths. When the cover is open, the flapper is exposed.

SUMMARY

In this type of image forming device, a user can easily pivot the flapper to expose the fixing unit when the cover is open. Exposing the fixing unit like this allows dust and other foreign matters to enter the fixing unit and damage the heat roller and the like, degrading printing results.

In view of the foregoing, it is an object of the invention to provide an image forming device capable of cautioning a user not to let foreign matters enter a fixing unit.

In order to attain the above and other objects, the invention provides an image forming device including a heat member, a pressure member, a main casing, a flapper, a regulating member, and a releasing-operation part. The heat member heats a toner image formed on a recording medium. The pressure member is in pressed contact with the heat member, forming a nip part therebetween. The main casing accommodates the heat member and the pressure member, and the main casing has a cover member that is movable between a first closed position for covering the heat member and a first open position for exposing the heat member. The flapper is disposed between the nip part and the cover member so as to be movable between a second closed position for covering the heat member and a second open position for exposing the heat member. The flapper toggles between conveying paths. The regulating member is capable of regulating movement of the flapper to the second open position when the cover member is in the first open position so as to maintain the heat member covered by the flapper. A user operates the releasing-operation part to release the regulation of the regulating member to the movement of the flapper when the cover member is in the first open position.

According to another aspect, the present invention provides an image forming device including a heat member, a pressure member, a main casing, a flapper, a regulating member, and a releasing-operation part. The heat member heats a toner image formed on a recording medium. The pressure member is in pressed contact with the heat member, forming a nip part therebetween. The main casing accommodates the heat member and the pressure member, and the main casing has a cover member that is movable between a first closed position for covering the pressure member and a first open position for exposing the pressure member. The flapper is disposed between the nip part and the cover member so as to be movable between a second closed position for covering the pressure member and a second open position for exposing the pressure member. The flapper toggles between conveying paths. The regulating member is capable of regulating movement of the flapper to the second open position when the cover member is in the first open position so as to maintain the pressure member covered by the flapper. A user operates a releasing-operation part to release the regulation of the regulating member to the movement of the flapper when the cover member is in the first open position.

BRIEF DESCRIPTION OF THE DRAWINGS

The particular features and advantages of the invention as well as other objects will become apparent from the following description taken in connection with the accompanying drawings, in which:

FIG. 4(*b*) is an illustrative cross-sectional side view of the fixing unit with the flapper in an open position;

FIG. 7(*a*) is an explanatory plan view showing a releasing member in a position to release the regulation of the regulating member to the flapper according to the first embodiment;

FIG. 7(*b*) is an explanatory plan view showing the releasing member with its abutment surface in abutment with the regulating member;

FIG. 7(*c*) is an explanatory plan view showing the regulating member regulating the movement of the flapper when the rear cover is open;

FIG. 8(*b*) is an explanatory left-side view of FIG. 7(*b*);

FIG. 8(*c*) is an explanatory left-side view of FIG. 7(*a*);

FIG. 9(*b*) is an explanatory left-side view of the fixing unit of the printer according to the second embodiment of the invention;

FIG. 10(*b*) is an explanatory side view showing condition of a flapper of the fixing unit of FIG. 10(*a*) when paper is jammed in the printer;

FIG. 10(*c*) is an explanatory side view of the fixing unit of FIG. 10(*a*), with a regulating member regulating the movement of a flapper;

FIG. 11(*a*) is an explanatory side view of a fixing unit and a rear cover of a printer according to a fourth embodiment of the invention;

FIG. 11(*b*) is an explanatory side view showing condition of a flapper of the fixing unit of FIG. 11(*a*) when paper is jammed; and FIG. 11(*c*) is an explanatory side view of the fixing unit of FIG. 11(*a*), with a regulating member regulating the movement of the flapper when the rear cover is open.

DETAILED DESCRIPTION

Figure 1:
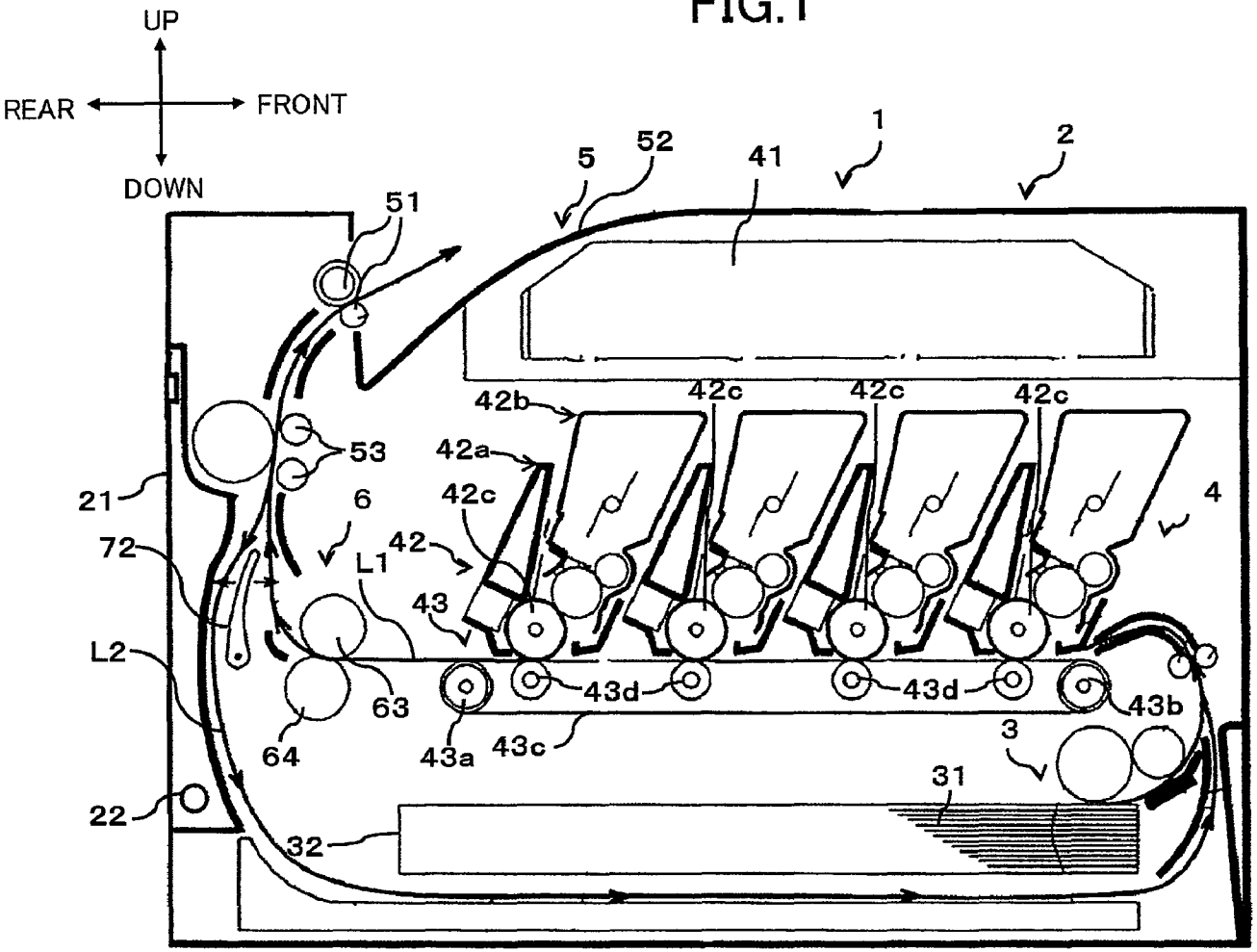
FIG. 1 is a cross-sectional side view showing overall configuration of a printer according to a first embodiment of the invention.

Image forming devices according to embodiments of the invention will be described while referring to the accompanying drawings wherein like parts and components are designated by the same reference numerals to avoid duplicating description.

The terms "upward," "downward," "upper," "lower," "above," "below," "right," "left," "front," "rear," and the like will be used throughout the description assuming that the image forming devices are disposed in an orientation in which they are intended to be used.

First, an image forming device according to a first embodiment of the invention will be described with reference to FIGS. 1 to 8(*c*). The first embodiment pertains to a color laser printer 1 shown in FIG. 1.

As shown in FIG. 1, the color laser printer 1 of the present embodiment includes a main casing 2, a paper supply section 3, an image forming section 4, and a discharge section 5.

The paper supply section 3 is disposed in a bottom section of the main casing 2 and has a paper tray 32 for accommodating a stack of recording paper 31, which is supplied to the image forming section 4 one at a time.

The image forming section 4 is disposed within the main casing 2 for forming an image on the recording paper 31 supplied from the paper supply section 3. The image forming section 4 includes a scanner section 41, a process section 42, a transfer section 43, and a fixing unit 6.

The scanner section 41 is disposed in an upper section of the main casing 2. Although not shown in the drawings, the scanner section 41 includes four scanner units each including a light source, a polygon mirror, a lens, and a reflection mirror, for respective colors. A laser beam from each light source is scanned left and right at a high speed at the polygon mirror, passes through the lens, is deflected at the deflection mirror, and is irradiated on a corresponding photosensitive drum 42*c* (described later), thereby forming an electrostatic latent image thereon.

The process section 42 is disposed below the scanner section 41 and above the paper supply section 3. The process section 42 includes four process units 42*a* and four developing cartridges 42*b* detachably attached to the respective process units 42*a*. Each process unit 42*a* has the photosensitive drum 42*c* and a charger (not shown) disposed in adjacent to the photosensitive drum 42*c*. Each developing cartridge 42*b* accommodates toner of each color for transforming the electrostatic latent image formed on the photosensitive drum 3 into a visible toner image.

The transfer section 43 is for transferring the toner images formed on the photosensitive drums 3 onto the recording paper 31 and includes a drive roller 43*a*, a follower roller 43*b*, a belt 43*c*, and four transfer rollers 43*d*.

The drive roller 43*a* and the follower roller 43*b* are disposed in parallel with each other with a space therebetween. The belt 43*c* is an endless belt and wrapped around the drive roller 43*a* and the follower roller 43*b*. Rotation of the drive roller 43*a* rotates the follower roller 43*b* and the belt 43*c*. The transfer rollers 43*d* are disposed within the belt 43*c* so as to confront the respective photosensitive drums 42*c* with an upper section of the belt 43*c* interposed therebetween.

Figure 3:
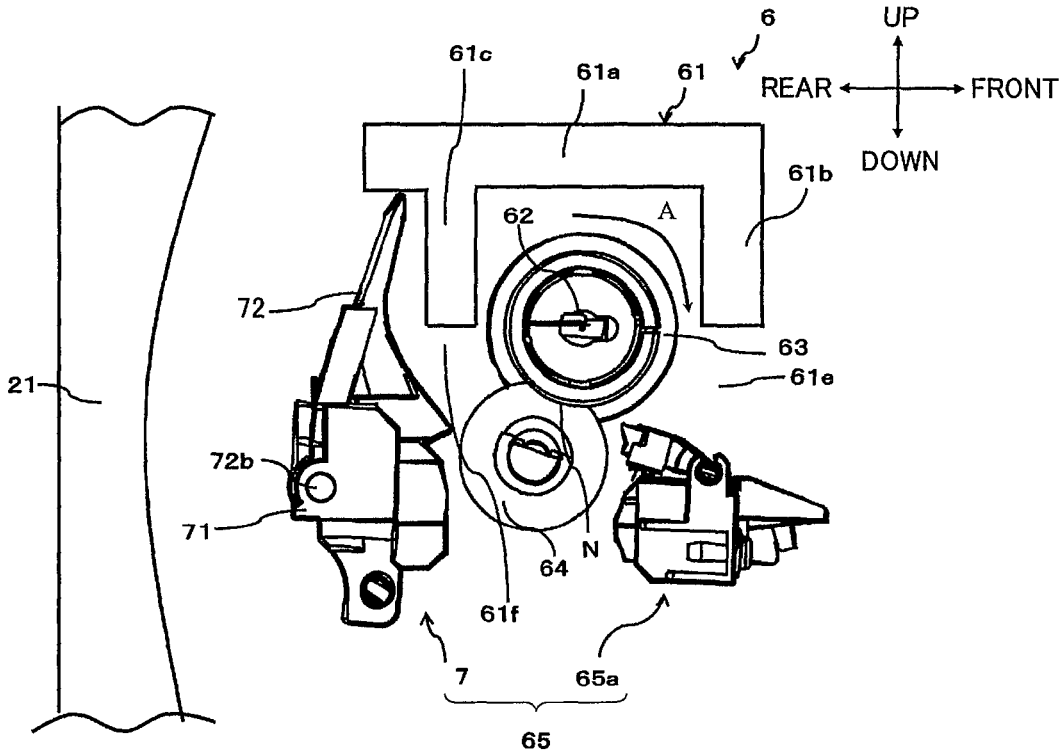
FIG. 3 is a cross-sectional side view of the fixing unit and a rear cover of the printer of FIG. 1.

As shown in FIG. 3, the fixing unit 6 includes a unit frame 61, a heater 62, a heat roller 63, a pressure roller 64, and a guide section 65.

The heater 62 heats the heat roller 63. The heat roller 63 has a rotary shaft extending in a width direction (right-to-left direction) and is driven to rotate in a direction indicated by an arrow A by driving force from a motor (not shown). The pressure roller 64 is pressed against the heat roller 63 for forming a nip part N therebetween, and rotates following the rotation of the heat roller 63. A toner image transferred onto the recording paper 31 is thermally fixed on the recording paper 31 at the nip part N as the recording paper 31 passes therethrough.

As shown in FIG. 1, the discharge section 5 includes various rollers including convey rollers 53 and discharge rollers 51 for conveying the recording paper 31 from the paper tray 32 along a conveying path L1 to a discharge tray 52 formed on top of the main casing 2.

The conveying path L1 is shaped substantially like the letter S, and a part of the conveying path L1 extends from the fixing unit 6 upward and then curves frontward. The conveying rollers 53 are disposed on the side of the conveying path L1. The discharge rollers 51 are for discharging the recording paper 31 onto the discharge tray 52.

The discharge tray 52 has a suitable depth for accommodating a stack of discharged recording paper 31 printed with images.

The color laser printer 1 also includes a flapper 72 and a reverse conveying path L2 defined within the main casing 2 for enabling to print images on both sides of the recording paper 31. The reverse conveying path L2 extends from the discharge rollers 51 to the transfer section 43 while passing by the flapper 72 and beneath the paper tray 32 so as to lead the recording paper 31 once conveyed to the discharge rollers 51 back to the transfer section 43.

The main casing 2 has a rear cover 21 that is pivotable about a first pivot shaft 22 between a first open position and a first closed position. When the rear cover 21 is in the first open position, the heat roller 63 and the pressure roller 64 can be exposed. However, when the rear cover 21 is in the first closed position shown in FIG. 1, the rear cover 21 covers the heat roller 63 and the pressure roller 64 so that a user cannot see the entire of the heat roller 63 or the pressure roller 64 when viewing the color laser printer 1 from the rear side.

Figure 4A:
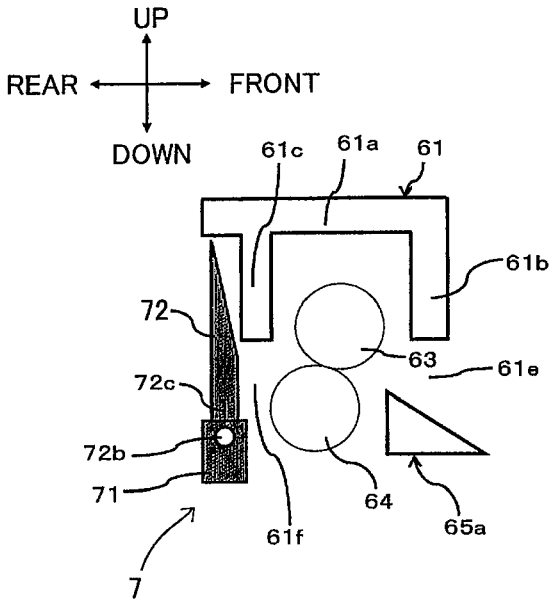
FIG. 4(*a*) is an illustrative cross-sectional side view of the fixing unit with a flapper in a closed position.
Figure 4B:
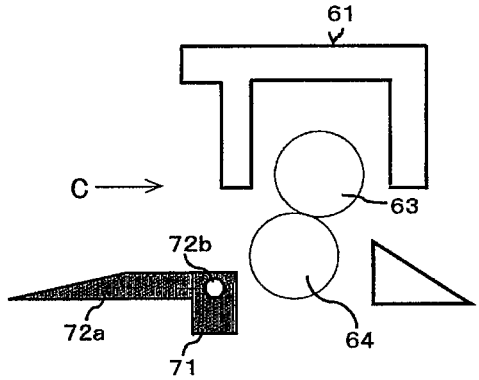
Figure 5:
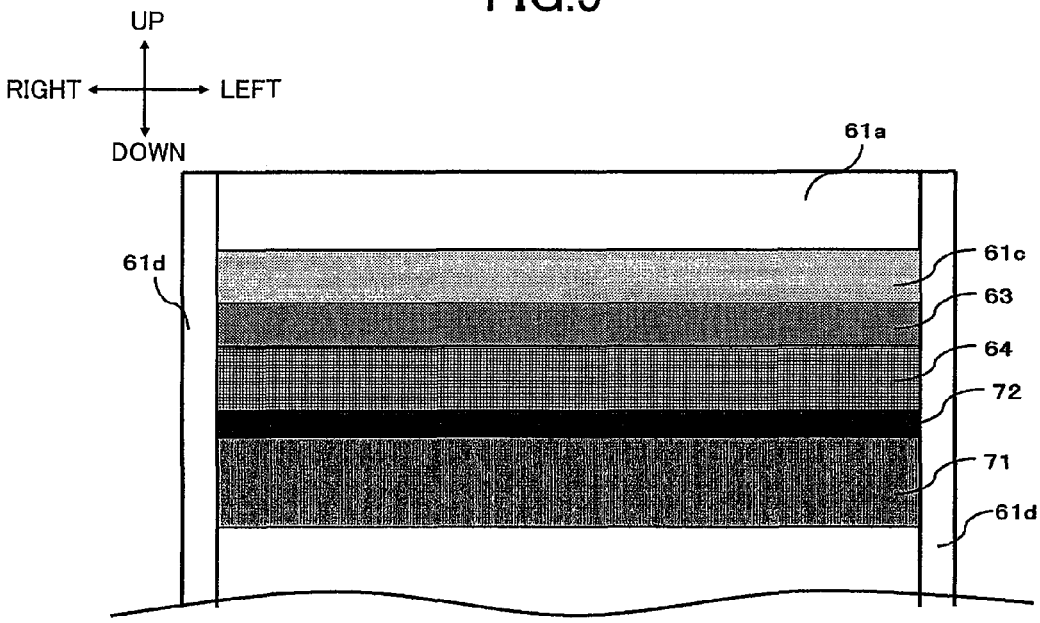
FIG. 5 is an illustrative view of the fixing unit from a point indicated by an arrow A of FIG. 4(*b*)

The fixing unit 6 will be described in detail. As shown in FIG. 4, the unit frame 61 has an upper frame 61*a*, a front frame 61*b*, a rear frame 61*c*, and side frames 61*d* (FIG. 5). The upper frame 61*a* covers the upper side of the heat roller 63. The front frame 61*b* partially covers the front side of the heat roller 63, and the rear frame 61*c* partially covers the rear side of the heat roller 63. The side frames 61*d* covers the left and right sides of the heat roller 63 and the pressure roller 64.

The front frame 61*b* defines an inlet port 61*e*, and the rear frame 61*c* defines an outlet port 61*f*. The recording paper 31 with the toner image transferred thereon at the transfer section 43 enters the unit frame 61 through the inlet port 61*e*, and then exits through the outlet port 61*f* after the toner image is thermally fixed onto the recording paper 31. The inlet port 61*e* and the outlet port 61*f* both have widths wider than the width of the recording paper 31 in the width direction.

As shown in FIG. 3, the guide section 65 has a front guide 65*a* and a rear guide 7. The front guide 65*a* is disposed on the front side of the heat roller 63 and below the front frame 61*b* for guiding a leading end of the recording paper 31 conveyed from the transfer section 43 to the nip part N.

Figure 2:
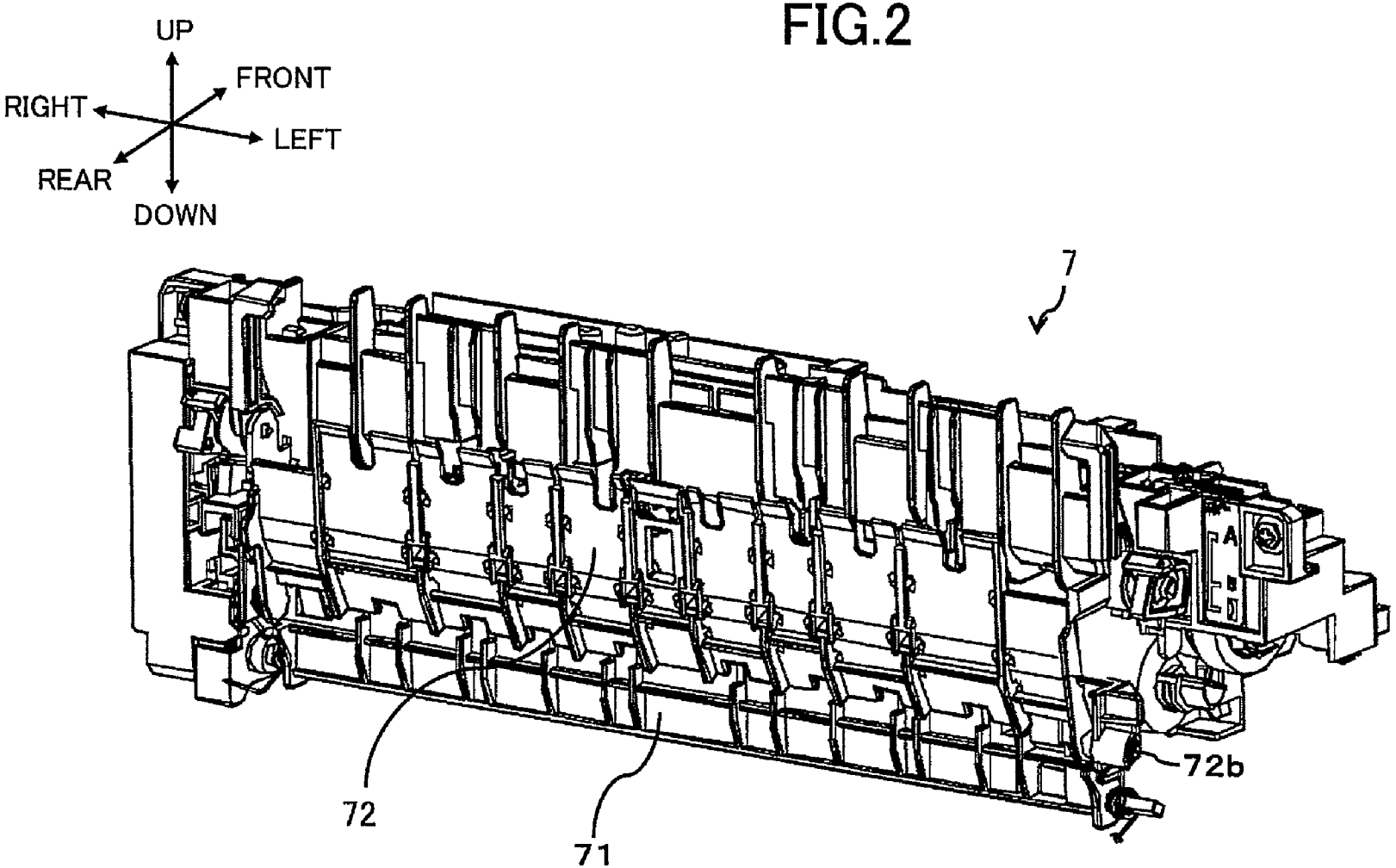
FIG. 2 is a perspective view of a rear guide of a fixing unit of the printer of FIG. 1.
Figure 6:
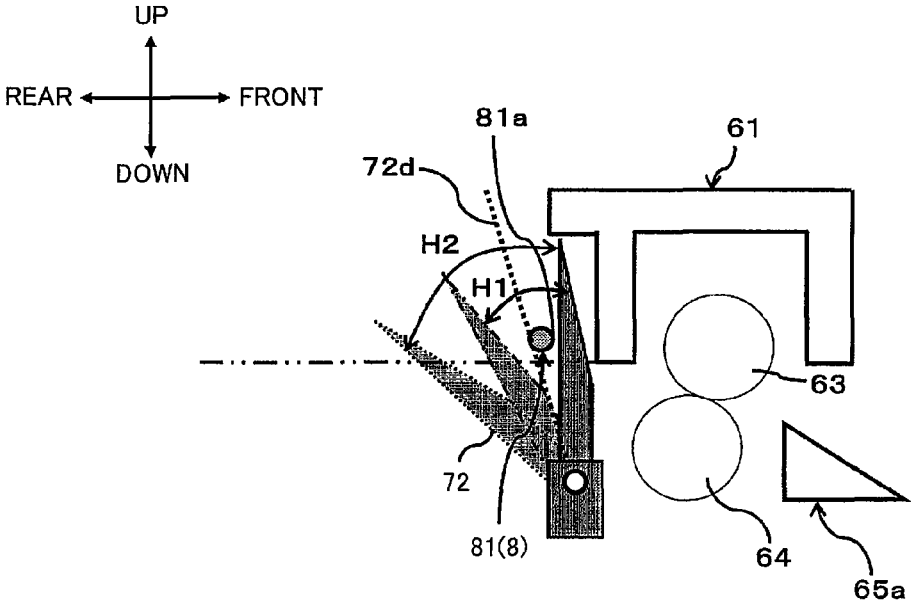
FIG. 6 is an explanatory view showing positional relationship between the flapper and a regulating member of the fixing unit.

As shown in FIG. 4, the rear guide 7 has a support frame 71, the flapper 72, a pair of springs 72*c* (only one is shown in the drawings), and a regulating unit 8 (FIG. 6). The support frame 71 is disposed between the rear cover 21 (FIG. 1) and the heat roller 63 in the front-to-rear direction and extends in the width direction as shown in FIG. 2. The support frame 71 is supported to the side frames 61*d* (FIG. 5) of the unit frame 61.

As shown in FIG. 2, the flapper 72 is in a plate shape elongated in the width direction. The flapper 72 has a pair of second pivot shafts 72*b* protruding outward from lateral sides of a lower part of the flapper 72. Each of the second pivot shafts 72*b* is received in holes (not shown) formed in the support frame 71. With this configuration, the flapper 72 is pivotable about the second pivot shafts 72*b* between a second closed position shown in FIG. 4(*a*) and a second open position shown in FIG. 4(*b*). When the flapper 72 is in the second closed position as shown in FIG. 4(*a*), the flapper 72 covers the heat roller 63 and the pressure roller 64. On the other hand, when the flapper 72 is in the second open position shown in FIG. 4(*b*), the heat roller 63 and the pressure roller 64 are exposed as shown in FIG. 5. It should be noted that "the flapper 72 covers the heat roller 63 and the pressure roller 64" means that the flapper 72 blocks the user from seeing nearly the entire of each of the heat roller 63 and the pressure roller 64 when the user views the printer 1 from the rear side.

The springs 72*c* shown in FIG. 4 are torsion coil springs wrapped on the respective second pivot shafts 72*b*. One end of each spring 72*c* is attached to the flapper 72, and the other end is attached to the support frame 71. The springs 72*c* urge the flapper 72 toward the second closed position, i.e., frontward.

Also, as shown in FIG. 1, the flapper 72 toggles between the conveying path L1 and the reverse conveying path L2. That is, when the recording paper 31 is discharged from the fixing unit 6, then the leading edge of the recording paper 31 pushes the flapper 72 rearward, i.e., in a direction opposite to a direction in which the springs 72*c* urge the flapper 72, to a guide position between the second open position and the second closed position, so the flapper 72 can guide the recording paper 31 discharged from the fixing unit 6 to follow the conveying path L1.

In a duplex printing, the discharge rollers 51 start rotating in reverse after the trailing edge of the recording paper 31 leaves the flapper 72 so as to convey the recording paper 31 in reverse. At this time, the flapper 72 is returned to the second closed position by the urging force of the springs 72*c*, and thus guides the trailing edge of the recording paper 31 to follow the reverse conveying path L2.

Specifically, the flapper 72 pivots in a range H1 shown in FIG. 6 between the second closed position and the guide position in order to toggle between the conveying paths L1 and L2. On the other hand, the flapper 72 can cover both the heat roller 63 and the pressure roller 64 within a range H2, and the range H1 is set within the range H2.

The regulating unit 8 shown in FIG. 6 is for regulating the pivotal movement of the flapper 72. As shown in FIG. 7(*a*), the regulating unit 8 has a regulating member 81 and a spring 82.

The regulating member 81 is in a rod-like shape extending in the width direction. The regulating member 81 is supported to the left side frame 61*d* (FIG. 5) of the unit frame 61 so as to be slidable in the width direction between a regulation position shown in FIG. 7(*c*) and a releasing position shown in FIG. 7(*a*) on the left side of the regulation position. The spring 82 is attached to a left side surface of the regulating member 81 and urges the regulating member 81 toward the regulation position.

The regulating member 81 has a regulation surface 81*a* and a slanting surface 81*b*. The regulation surface 81*a* faces frontward and extends in the width direction. The slanting surface 81*b* faces diagonally rightward and rearward. That is, the slanting surface 81*b* extends diagonally rightward toward the front. As shown in FIG. 6, the regulating unit 8 is located such that the regulation surface 81*a* is closer to the second closed position of the flapper 72 than the center 72*d* of the range H1 between the guide position and the second closed position of the flapper 72.

When the regulating member 81 is in the regulation position as shown in FIG. 7(*c*), the regulation surface 81*a* abuts the rear surface of the flapper 72, so the regulating member 81 regulates the pivotal movement of the flapper 72 toward the rear side. On the other hand, when the regulating member 81 is in the releasing position shown in FIG. 7(*a*), the regulating member 81 does not regulate the pivotal movement of the flapper 72.

As shown in FIG. 7(*c*), the rear cover 21 is formed with a first releasing member 23 that protrudes inward, i.e., toward the front, for releasing the regulation of the regulating member 81 to the flapper 72. The releasing member 23 has an abutment surface 23*a* at a free end and a side surface 23*b*. The abutment surface 23*a* faces diagonally frontward and leftward. The abutment surface 23*a* is for abutting the slanting surface 81*b* of the regulating member 81. The side surface 23*b* is facing leftward.

When the rear cover 21 is in the first closed state, the regulating member 81 is in the releasing position shown in FIG. 7(*a*). In this condition, a right end of the regulating member 81 is in abutment with the side surface 23*b* of the releasing member 23, so the regulating member 81 cannot move to the regulation position. Thus, the flapper 72 is freely pivotably movable without being regulated by the regulating member 81.

Figures 8A, 8B, 8C:
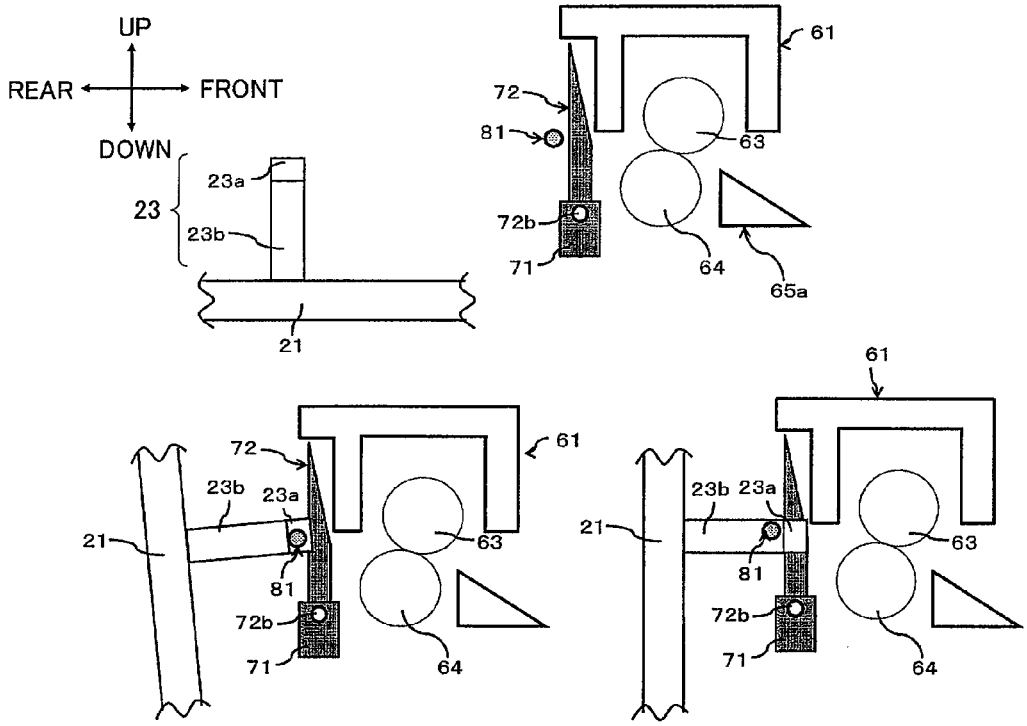
FIG. 8(*a*) is an explanatory left-side view of FIG. 7(*c*)

However, as a user opens the rear cover 21, the releasing member 23 displaces rearward, allowing the regulating member 81 to move rightward, and the slanting surface 81*b* comes into abutment with the abutment surface 23*a* as shown in FIG. 7(*b*). If the user opens the rear cover 21 wider to the first open position as shown in FIG. 8(*a*), the regulating member 81 no longer contacts the releasing member 23 and thus moves to the regulation position as shown in FIG. 7(*c*).

In this condition, if the user tries to move the flapper 72 toward the second open position, the flapper 72 abuts the regulation surface 81*a* of the regulating member 81 and thus is prevented from moving to the second open position. Because the flapper 72 is maintained closed in this manner, the flapper 72 stays covering both the heat roller 63 and the pressure roller 64, thereby preventing exposure of the heat roller 63 and the pressure roller 64.

Such regulation to the flapper 72 by the regulating member 81 can be released in the following manner.

As shown in FIGS. 7(*b*) and 8(*b*), in the course of closing the rear cover 21 from the first open position to the first closed position, the abutment surface 23*a* of the releasing member 23 comes into abutment with the slanting surface 81*b* of the regulating member 81 and pushes the regulating member 81 leftward against the urging force of the spring 82. When the rear cover 21 reaches the first closed position as shown FIGS. 7(*a*) and 8(*c*), the right end of the regulating member 81 contacts the side surface 23*b* of the releasing member 23. As a result, the regulation by the regulating member 81 is released. This state is maintained even after the user releases his/her hand from the rear cover 21.

The regulation to the flapper 72 can be released also when the rear cover 21 is open. That is, while the rear cover 21 is in the first open position, the user touches the regulation surface 81*a* to move the regulating member 81 to the releasing position. This releases the regulation to the flapper 72 and allows the user to move the flapper 72 to the second open position. Thus, the user can access the fixing unit 6 to clear paper jam, for example.

As described above, according to the present embodiment, the regulating member 81 prevents the flapper 72 from exposing the heat roller 63 and the pressure roller 64 when the rear cover 21 is in the first open position. Thus, it is possible to prevent foreign matters from entering the unit frame 61 and clinging to the heat roller 63 or the pressure roller 64.

Also, because the regulating member 81 is, as shown in FIG. 6, located closer to the second closed position than the center 72*d* of the range H1 in which the flapper 72 pivots for toggling the conveying path, the flapper 72 can reliably cover the heat roller 63 and the pressure roller 64, thereby preventing damages to the surfaces of the heat roller 63 and the pressure roller 64 due to foreign matters clinging thereto.

Further, because the regulation to the flapper 72 is released by simply closing the rear cover 21, it is unnecessary for the user to perform a separate operation to release the regulation to the flapper 72, This enhances the operability for the user.

Moreover, because the releasing member 23 releases the regulation to the flapper 72 by the regulating member 81 when the rear cover 21 is closed, the flapper 72 can toggle the conveying path during the image forming operations.

Next, an image forming device according to a second embodiment of the present invention will be described with reference to FIGS. 9(*a*) and 9(*b*). The image forming device of the present embodiment is a laser printer similar to the laser printer 1 of the above-described first embodiment, but differs in including a fixing unit 60 shown in FIG. 9(*a*) instead of the fixing unit 6.

Figure 9A:
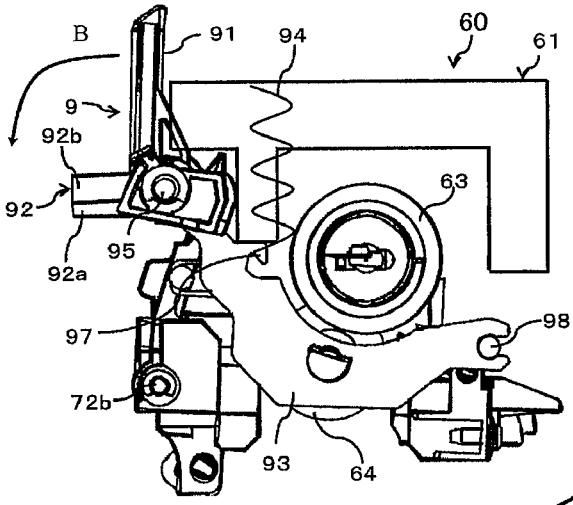
FIG. 9(*a*) is an explanatory left-side view of a fixing unit of a printer according to a second embodiment of the invention.
Figure 9B:
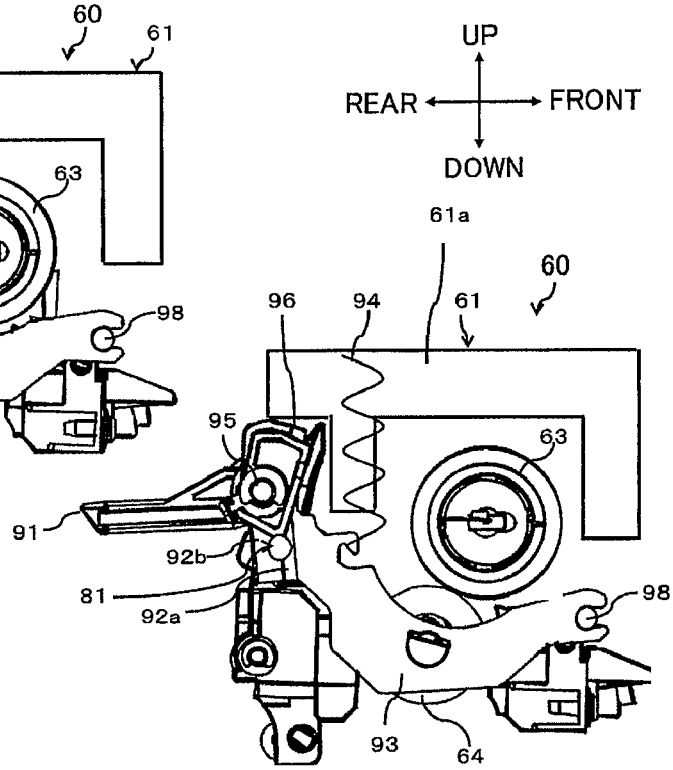
Figure 10A:
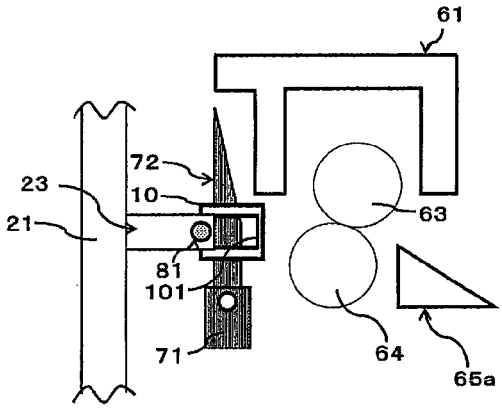
FIG. 10(*a*) is an explanatory side view showing a fixing unit and a rear cover of a printer according to a third embodiment of the invention.
Figure 10B:
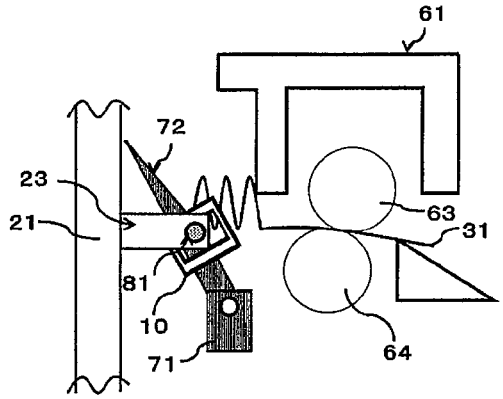
Figure 10B:
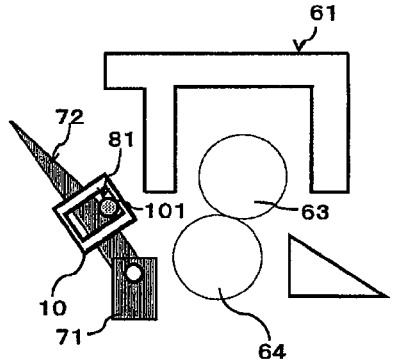
Figure 10C:
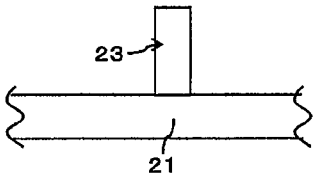
Figure 10C:
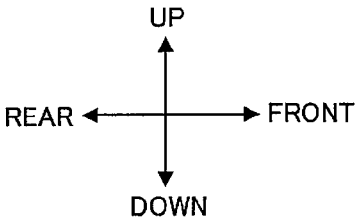

As shown in FIG. 9(*a*), the fixing unit 60 includes a pair of nip-pressure changing mechanisms 9 (only one is shown in the drawings) one supported to either of the side frames 61*d* (FIG. 5) of the unit frame 61. Each nip-pressure changing mechanism 9 includes an operation member 91, a releasing member 92, a support member 93, and a spring 94.

The operation member 91 is pivotable about a third pivot shaft 95 in a direction indicated by an arrow B. As shown in FIG. 9(*b*), the operation member 91 has a contact surface 96. The operation member 91 is disposed such that the rear cover 21 in the first closed position covers the operation member 91 and that the operation member 91 is exposed when the rear cover 21 is in the first open position.

As shown in FIG. 9(*a*), the releasing member 92 is formed at a section of the operation member 91 near the third pivot shaft 95 so as to protrude rearward, i.e., in a direction perpendicular to the width direction in which the third pivot shaft 95 extends. The releasing member 92 has an abutment surface 92*a* and a side surface 92*b*. The abutment surface 92*a* is slanting rightward toward the bottom.

The support member 93 supports the pressure roller 64 so as to be rotatable, and is supported to a protrusion 98 formed on the corresponding side frame 61*d* of the unit frame 61.

A lower end of the spring 94 is engaged to an engaging part 97 of the support member 93, and an upper end of the spring 94 is fixed to the unit frame 61 of the fixing unit 60. In this configuration, the spring 94 urges the support member 93 upward.

When the user presses the operation member 91 downward in the direction B from the position shown in FIG. 9(*a*) to the position shown in FIG. 9(*b*), the operation member 91 presses the rear upper end of the support member 93 downward, so the support member 93 pivots downward about the protrusion 98 against the urging force of the spring 94. This lowers the pressure roller 64 supported to the support member 93, decreasing the nip pressure between the heat roller 63 and the pressure roller 64. Also, the contact surface 96 is brought into abutment with the upper frame 61*a*. Abutment between the contact surface 96 and the upper frame 61*a* maintains the operation member 91 in the position shown in FIG. 9(*b*) even if the user releases his/her hand from the operation member 91. In this manner, the user can change the nip pressure between the pressure roller 64 and the heat roller 63.

Also, when the user moves the operation member 91 toward the position shown in FIG. 9(*b*), the abutment surface 92*a* of the releasing member 92 comes into contact with the slanting surface 81*b* of the regulating member 81 (FIG. 7(*a*)) and pushes the regulating member 81 leftward. When the operation member 91 reaches the position shown in FIG. 9(*b*), the regulation to the flapper 72 by the regulating member 81 is released.

With this configuration, the process to decrease the nip pressure between the heat roller 63 and the pressure roller 64 can also release the regulation of the regulating member 81 to the flapper 72. This enhances operability of a user when removing jammed paper from the fixing unit 60.

Next, an image forming device according to a third embodiment of the present invention will be described with reference to FIGS. 10(*a*) to 10(*d*). The image forming device of the present embodiment is a laser printer similar to the laser printer 1 of the above-described first embodiment, but differs in having an engaging member 10 shown in FIG. 10(*a*). The engaging member 10 has a rectangular ring shape with a rectangular through hole large enough to receive the regulating member 81 therein. The engaging member 10 is provided on the side surface of the flapper 72.

When the recording paper 31 just passed through the fixing unit 6 gets jammed as shown in FIG. 10(*b*), then the jammed paper 31 pushes the flapper 72, so the flapper 72 pivots rearward together with the engaging member 10. In this condition, the rear side surface of the flapper 72 is positioned further rearward than the regulating member 81. Thus, even if the releasing member 23 on the rear cover 21 retracts rearward when the rear cover 21 is open, the regulating member 81 cannot abut the rear side surface of the flapper 72 to regulate the pivotal movement of the flapper 72. However, when the user opens the rear cover 21 as shown in FIG. 10(*c*), then the regulating member 81 moves rightward and enters the through hole of the engaging member 10 and contacts a front surface 101 of the through hole. Thus, even if the user tries to pivot the flapper 72 further rearward, the flapper 72 cannot move further rearward because of the regulating member 81 and thus is maintained covering the heat roller 63 and the pressure roller 64.

When the rear cover 21 is closed to the position shown in FIG. 10(*a*), the regulation of the regulating member 81 to the flapper 72 is released in the same manner as in the above-described first embodiment.

According to the third embodiment, the pivotal movement of the flapper 72 is regulated by the engagement between the engaging member 10 and the regulating member 81 when the user opens the rear cover 21 in a condition where the jammed paper has moved the flapper 72. This cautions the user to be careful not to let foreign matters enter the fixing unit 6 and cling to the heat roller 63 and the pressure roller 64.

Next, an image forming device according to a fourth embodiment of the present invention will be described with reference to FIGS. 11(*a*) to 11(*c*). The image forming device of the present embodiment is a laser printer similar to the laser printer 1 of the above-described first embodiment, but differs in having another regulating member 83 shown in FIG. 11(*a*) in addition to the regulating member 81.

The regulating member 83 is disposed on the rear side of the regulating member 81 (between the rear cover 21 and the regulating member 81) and has the same configuration as the regulating member 81.

When the recording paper 31 just passed the fixing unit 6 gets jammed as shown in FIG. 11(*b*), the flapper 72 is pivoted rearward by the jammed paper 31. In this condition, the rear surface of the flapper 72 is located between the regulating members 81 and 83. If the user opens the rear cover 21 as shown in FIG. 11(*c*), then the releasing member 23 no longer prevents the regulating members 81 and 83 from moving rightward. However, in a condition shown in FIG. 10(*b*), the rear surface of the flapper 72 is positioned to the rear of the regulating member 81, so the regulating member 81 cannot abut the rear side surface of the flapper 72 to regulate the pivotal movement of the flapper 72. However, the regulating member 83 located to the rear of the flapper 72 can regulate the pivotal movement of the flapper 72 by abutting the same.

In this manner, even if paper jam occurs, the regulating member 83 can regulate the pivotal movement of the flapper 72 when the rear cover 21 is opened.

When the rear cover 21 is closed, the releasing member 23 can release the regulation of the regulating member 83 to the flapper 72 in the same manner as the regulation of the regulating member 81 described above.

While the invention has been described in detail with reference to the embodiments thereof, it would be apparent to those skilled in the art that various changes and modifications may be made therein without departing from the spirit of the invention.

For example, the flapper 72 may be supported to the main casing 2, but not to the fixing unit 6 (60). Also, a pair of regulating members 81 (83) may be provided one on either side of the flapper 72.

What is claimed is:

1. An image forming device comprising:

a heat member that heats a toner image formed on a recording medium;

a pressure member in pressed contact with the heat member, forming a nip part therebetween;

a main casing accommodating the heat member and the pressure member, the main casing having a cover member that is movable between a first closed position for covering the heat member and a first open position for exposing the heat member;

a flapper disposed between the nip part and the cover member so as to be movable between a second closed position for covering the heat member and a second open position for exposing the heat member, the flapper toggling between conveying paths;

a regulating member configured to regulate movement of the flapper to the second open position when the cover member is in the first open position so as to maintain covering of the heat member by the flapper; and a releasing-operation part configured to be user-operable to release the regulation of the regulating member to the movement of the flapper when the cover member is in the first open position.

2. The image forming device according to claim 1, further comprising a first releasing member that releases the regulation of the regulating member to the movement of the flapper when the cover member is moved to the first closed position, wherein:

the flapper toggles between the conveying paths by moving in a predetermined range, wherein the flapper covers the heat member within the predetermined range; and the regulating member is disposed nearer to the second closed position than a center of the predetermined range.

3. The image forming device according to claim 2, wherein:

the regulating member is movable between a regulation position and a releasing position; and the first releasing member projects from the cover member toward the regulation member and is configured to release the regulation to the movement of the flapper by moving the regulation member from the regulation position to the releasing position when the cover member is moved to the first closed position.

4. The image forming device according to claim 1, further comprising a nip-pressure changing mechanism that changes a nip-pressure at the nip part, the nip-pressure changing mechanism including:

the releasing-operation part that is covered by the cover member in the first closed position and that is exposed when the cover member is in the first open position;

a pressure-changing member that changes the nip-pressure; and a second releasing member configured to release the regulation to the movement of the flapper, wherein operation on the releasing-operation part causes the pressure-changing member to decrease the nip-pressure and the second releasing member to release the regulation to the movement of the flapper.

5. The image forming device according to claim 1, wherein the regulation member is disposed between the second closed position and the second open position.

6. The image forming device according to claim 1, further comprising an engaging member disposed on the flapper, the engaging member being formed with a hole configured to receive the regulating member.

7. The image forming device according to claim 1, further comprising a third regulating member configured to regulate the movement of the flapper to the second open position when the cover member is in the first open position in order to maintain covering of the heat member by the flapper, the third regulating member being positioned between the first regulating member and the cover member.

8. An image forming device comprising:

a heat member that heats a toner image formed on a recording medium;

a pressure member in pressed contact with the heat member, forming a nip part therebetween;

a main casing accommodating the heat member and the pressure member, the main casing having a cover member that is movable between a first closed position for covering the pressure member and a first open position for exposing the pressure member;

a flapper disposed between the nip part and the cover member so as to be movable between a second closed position for covering the pressure member and a second open position for exposing the pressure member, the flapper toggling between conveying paths;

a regulating member configured to regulate movement of the flapper to the second open position when the cover member is in the first open position so as to maintain covering of the pressure member by the flapper; and a releasing-operation part configured to be user-operable to release regulation of the regulating member to the movement of the flapper when the cover member is in the first open position.

9. The image forming device according to claim 8, further comprising a first releasing member projecting from the cover member toward the regulation member, wherein:

the regulating member is movable between a regulation position and a releasing position; and the first releasing member is configured to release the regulation to the movement of the flapper by moving the regulation member from the regulation position to the releasing position when the cover member is moved to the first closed position.

10. The image forming device according to claim 8, further comprising a nip-pressure changing mechanism that changes a nip-pressure at the nip part, the nip-pressure changing mechanism including:

the releasing-operation part that is covered by the cover member in the first closed position and that is exposed when the cover member is in the first open position;

a pressure-changing member that changes the nip-pressure; and a second releasing member configured to release the regulation to the movement of the flapper, wherein operation on the releasing-operation part causes the pressure-changing member to decrease the nip-pressure and the second releasing member to release the regulation to the movement of the flapper.

* * * * *